US005502535A

United States Patent [19]

Desai

[11] Patent Number: 5,502,535

[45] Date of Patent: Mar. 26, 1996

[54] METHOD AND APPARATUS FOR PROCESSING PHOTOSENSITIVE SHEET MATERIAL

[75] Inventor: Basavaraj R. Desai, Knoxville, Tenn.

[73] Assignee: Picture Productions, Knoxville, Tenn.

[21] Appl. No.: 292,515

[22] Filed: Aug. 18, 1994

[51] Int. Cl.[6] ..... G03D 3/02

[52] U.S. Cl. ..... 354/324; 354/325; 354/331

[58] Field of Search ..... 354/313, 317, 354/319–325, 331, 336; 134/64 P, 64 R, 122 P, 122 R

[56] References Cited

U.S. PATENT DOCUMENTS 3,405,627 10/1968 Day ..... 354/320
3,610,131 10/1971 Frick et al. ..... 354/320
3,636,925 1/1972 Reuter, Jr. et al. ..... 118/637
3,651,782 3/1972 MacDonald, Jr. ..... 118/637 X
5,059,997 10/1991 Hall et al. ..... 354/324
5,302,996 4/1994 Hall et al. ..... 354/324

*Primary Examiner*—D. Rutledge
*Attorney, Agent, or Firm*—Pitts & Brittian

[57] ABSTRACT

Flexible, photosensitive sheet material such as photographic film is processed for development through an apparatus comprising one or more cells, each having top and bottom plates in matched assembly to provide a thin film transit channel therebetween. Transverse of the film transit direction, fluid channel serrations are provided in top, bottom or both plates between developer solution supply and extraction manifolds.

32 Claims, 9 Drawing Sheets

METHOD AND APPARATUS FOR PROCESSING PHOTOSENSITIVE SHEET MATERIAL

BACKGROUND OF THE INVENTION

This invention relates generally to the processing of photosensitive sheet material and, more particularly, is concerned with the processing of two-sided photosensitive sheet material with a minimal amount of liquid processing solution, such as developer solution.

Photosensitive sheet material (PSM), as used herein and with which this invention is concerned, is intended to include a substantially flexible base sheet or web having a coating of photographic emulsion carried on at least one of the major faces of the sheet. As a descriptive term used herewith, "sheet " shall mean suitable materials of either discrete or indefinite length. Suitable materials may include film, web or plate. Commonly, the PSM emulsion includes a plurality of layers wherein each layer is designed to produce a specific result when allowed to react with developer solution. For example, in the photographic art, reproduction of a normal image is commonly accomplished by exposing a photosensitive material such as, for example, a photographic film, to visible light reflected from an object or image, and then the exposed PSM (film) is thereafter developed to produce a negative reproduction on a flexible, transparent substrate. Development of such flexible PSM commonly includes a series of processing steps such as immersing the emulsion-carrying substrate in a developer solution to bring forth the desired image followed by immersion in a fixer solution and thereafter subjected to one or more water washing steps. As used herein, reference to a "processing solution " shall include water and water washing.

More particularly, photosensitive materials, as envisioned by this description, are those that are selectively responsive to radiant energy, whether transmitted, reflected or emitted. PSM responsive radiant energy includes the expanded spectrum of visible, ultraviolet, infrared and X-ray.

The art of X-ray photography is similar to reflected radiation photography except that the radiation energy passes through the examination object to be relatively screened dependent on density and other characteristics of the object. Such relative screening produces energy variation patterns in a radiation wave through and across an irradiated area. Certain photosensitive materials respond to such radiation energy with such sensitivity as to produce a shadow image of the examination object showing only elements of selected common characteristics, e.g. bone, for example. Due to the potential for radiation energy such as X and gamma ray to injure the irradiated object, radiation photography in such cases is conducted at minimum levels of intensity or energy density. To compensate for a reduced incidence of excitation energy, many types of X-ray films are prepared with emulsion coated on both surfaces of a transparent substrate. Development of such two-sided PSM requires great attention to all process control parameters such as time, temperature and developer/film solution agitation imposed simultaneously upon both surfaces of the PSM coated film.

Developer solutions comprise combinations of chemicals, generally in aqueous solution, wherein each of the chemicals is chosen to react with one or more of the constituents in one or more of the layers of the emulsion to produce a specific result. The quality of the resulting product depends, to a large extent, upon the nature of the physical contact of the PSM with the developer solution. However, chemical reactions which occur during development of a PSM generate by-products that are released in the developer solution which, in turn, renders the developer solution less effective. Therefore, it is important that during a development process, developer solution in contact with the PSM be cyclically exchanged to continuously expose the PSM to fresh or relatively less-depleted solution.

The type of apparatus with which this invention is concerned includes one or more film processing cells, each including a plurality of internal cavities for containing a processing solution, such as a developer solution, so that the liquid body of solution contained within the cell cavities substantially is a flowing film. During a processing step with such a substantially thin reservoir cell, a PSM film end is inserted through an opening provided in each cell and into the body of solution contained therein and conveyed through the cell so that the processing solution acts upon the PSM in a desired manner and for a predetermined period of time. The apparatus may include a series of such reservoir cells arranged in a side-by-side arrangement so that conveyance of a PSM in sequence through the cells exposes the PSM in succession to the working fluid contained within each cell. The number of cells, cavities within each cell and the characteristics of the solution contained within each cell depends upon the characteristics which the PSM is desired to exhibit when processed. In addition, the rate at which the PSM is conveyed through any one cell and the rate of replenishment of the fluid contained within the one cell are commonly coordinated to control the exposure of the PSM to the working fluid within the one cell.

A reservoir cell of the aforedescribed class is shown and described in U.S. Pat. No. 5,266,994, the disclosure of which is incorporated herein by reference. In one embodiment of the reservoir cell described in the referenced patent, there is provided a plurality of elongated woven fabric loops which are secured to the upper part of the reservoir cell so that the bight of the loop extends downwardly into the reservoir cavity. A PSM which is moved through the cavity of such a cell slidably moves in contact with the underside of the loops so that the volumetric amounts of developer solution in contact with the emulsion is replaced with fresh or less-depleted volumetric amounts of developer solution. Heretofore, however, the distribution of replacement solution throughout the cavity was, to a large extent, unpredictable. It would therefore be desirable to provide a reservoir cell wherein the distribution of replacement solution through the cell cavity is improved.

There are many processing chemicals, e.g., those which possess a pH greater than 11.0, which are susceptible to oxidation or degradation when exposed to air. When such a chemical remains within a cell of the aforedescribed class for a prolonged period of time, such as overnight, the chemical loses some of its effectiveness and may be rendered undesirable. It would be desirable to provide a reservoir cell wherein the likelihood of oxidation of processing solution contained within the cell cavity is substantially reduced so that if the solution is left within the cell for a prolonged period of time, the effects of oxidation of the solution are also reduced.

When devices and systems of the type described are emptied of processing solution, whether by reason of solution change, clean-up or extended periods of non-use, difficulties arise upon refill due to air trapped within the processing cells. Hydraulic characteristics of some solutions include relatively high surface tension properties. While a high surface tension property may be used advantageously for sealing a fully charged cell, the property also disadvantageously supports bubble volumes trapped against a cell roof. These bubble volumes restrict, distort and otherwise inhibit or distort circulatory flow of the processing solution through the cell and prevent a uniform distribution of processing solution reactivity. A means or procedure for purging such a PSM processing cell of solution entrained air would greatly contribute to the process uniformity of the cell. In the case of extremely sensitive, two-sided photosensory materials, removal of bubbles from the processing solution, especially developer solution is important.

It is also well known that photographic processing operations are quite sensitive to temperature changes. Depending upon the process, temperatures may need to be held typically within ranges of between ±0.5° F. to ±2.0° F. from a base temperature for consistency and optimum results. In processing applications of the type with which this invention is concerned, i.e., those involving a relatively small amount of liquid processing solution, and especially, solution disposed in a thin, flowing, liquid film, even a small differential between the temperature of a reservoir cell and that of the working fluid introduced into the cell may alter, e.g., cool, the temperature of the introduced working fluid to such an extent that the temperature of the process operation is outside of an acceptable range. It would therefore be desirable to provide a reservoir cell Wherein the temperature of the working fluid contained therein can be accurately controlled at the point of reactive contact with the PSM object.

An aspect of the present invention is to provide a new and improved system and method of utilizing a reservoir cell of the aforedescribed class wherein the distribution of processing solution throughout the cell cavity is enhanced.

An additional object of the present invention will be to provide a PSM processing cell that presents photo processing solution substantially identically and simultaneously to both emulsion coated surfaces of a two-sided PSM.

A further object of the present invention is to provide a two-sided PSM processing apparatus that circulates processing solution respective to a given process cell over both emulsion coated surfaces.

Another object of the present invention is the provision of a PSM processing cell for simultaneously treating both faces of a two-sided photosensitive film that may be readily purged of atmospheric gas when charged with minimal quantities of processing solution.

Another aspect of the present invention is to provide a new and improved reservoir cell of the aforedescribed class which reduces the likelihood of aerial oxidation of processing solution contained within the cell cavity.

An additional aspect of the present invention is stimulated dispersion of the processing solution within a cell as a result of finely perforated mesh disposed across transverse ridges within the cell cavity.

Still another aspect of the present invention is to provide a new and improved system and method utilizing a reservoir cell of the aforedescribed class wherein the temperature of the working fluid contained within the cell can be accurately controlled.

SUMMARY OF THE INVENTION

This invention relates to a system, apparatus and method for use in the processing of a flexible PSM having a photosensitive emulsion on at least one face thereof and, in particular, on both faces. The invention apparatus utilizes one or more PSM process cells, each comprising an upper and lower plate assembled to provide a PSM transit slot therebetween. Either or both plates are provided with a plurality of flow channels which carry a moving film of processing solution across the moving PSM surface in a direction transverse to the direction of PSM travel. Each channel is confined between flanking ridges which parallel the solution flow direction.

Channels in an upper cell plate are vented to the atmosphere to release air confined in the upper cell roof structure.

Although numerous cross-sectional shapes are suitable for the cell flow channels such as sinusoidal and wide vee sections, a preferred section is a raked saw-tooth configuration with the tooth point oriented along the PSM traveling direction. Tooth points respective to upper and lower cell plates may be offset in the PSM travel direction.

Another preferred embodiment of the invention may include a fine mesh screen stretched over the tooth points to define a flow channel enclosure between the screen body and the tooth ramp.

Process solution temperature is maintained by an external liquid bath heat exchanger in which the heat medium liquid is temperature monitored for comparison to a set-point. Predetermined differentials from the set-point initiate the operation of a direction water heating means. Processing solution respective to each cell having the controlled bath operating temperature is passed through the bath within heat exchange conduits.

The cell plate structure also has positive heat control by means of embedded electric heating elements secured intimately to the cell plate. Temperature sensor means embedded in the cell plate structure is, in combination with electric switch control means, used to keep the respective cell plate structure within the predetermined temperature range.

To further stabilize the temperature of the PSM processing unit, all processing cells are enclosed within a housing, preferably insulated or of low heat transfer material wherein the internal housing atmosphere is circulated, filtered, temperature monitored and heated accordingly.

DESCRIPTION OF THE PREFERRED EMBODIMENTS

Figure 1:
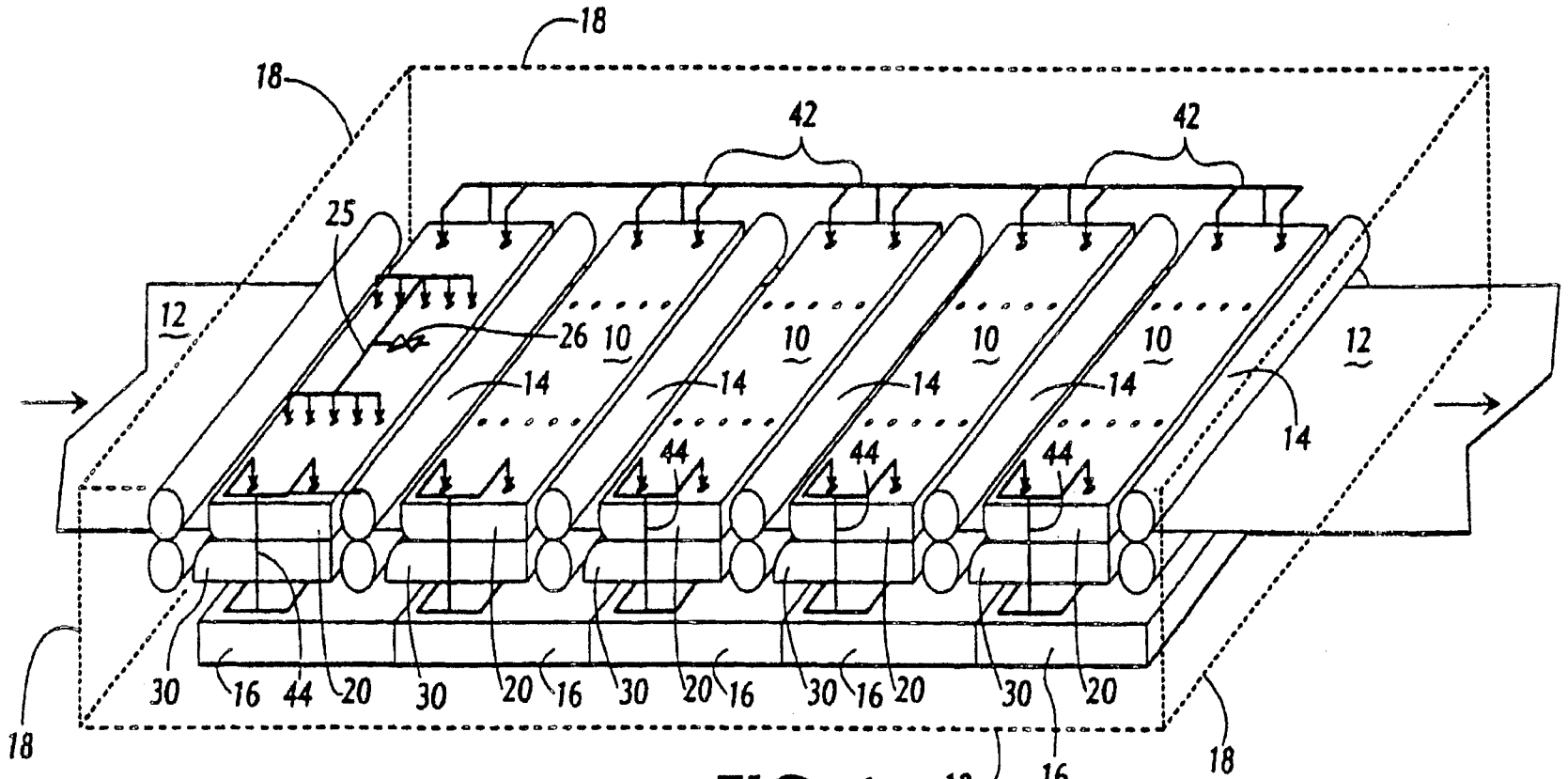
FIG. 1 is a schematic perspective view of processing equipment with which the method of the present invention is carried out.

With respect to the drawings wherein like reference characters designate like or similar elements throughout the several figures of the drawings, the schematic of FIG. 1 represents an assembly of five multisegmented process cells 10 in serial alignment along a photosensitive material (PSM) 12 process traveling route. In typical sequence, the first cell will circulate developer solution, the second cell will circulate fixer solution and the remaining cells circulate wash water.

In an embodiment of the invention preferred for processing two-sided PSM having radiation exposed, photosensitive emulsion coated on the two opposite surfaces of the substrate 12, a process cell 10 comprises upper and lower plates 20 and 30, respectively. A rotatively driven pair of squeegee rolls 14 are positioned on the outflow side of each cell 10 to nip the PSM 12 dry of the preceding process solution and pull the PSM through the cell.

Physical dimensions of a cell may vary greatly. For example, a wash cell in a 35 mm film development sequence may comprise only one segment and measure only about 1 inch in the PSM travel direction and only about 1.5 inch transversely of the travel direction. Conversely, a developer cell in an enlargement sequence may measure 15 inches in the PSM travel direction and 30 inches transversely.

Plates 20 and 30 and rolls 14 respective to a single cell 10 are located above a corresponding overflow tray 16 which may or may not be in circulation circuit with the process solution of the respective cell unit 10. See FIG. 8. The primary function of trays 16 is as catch-basins for excess or sealing flow of process solution from within the respective cell. In most cases, this is oxidized or contaminated solution not desired for recirculation.

Figure 2:
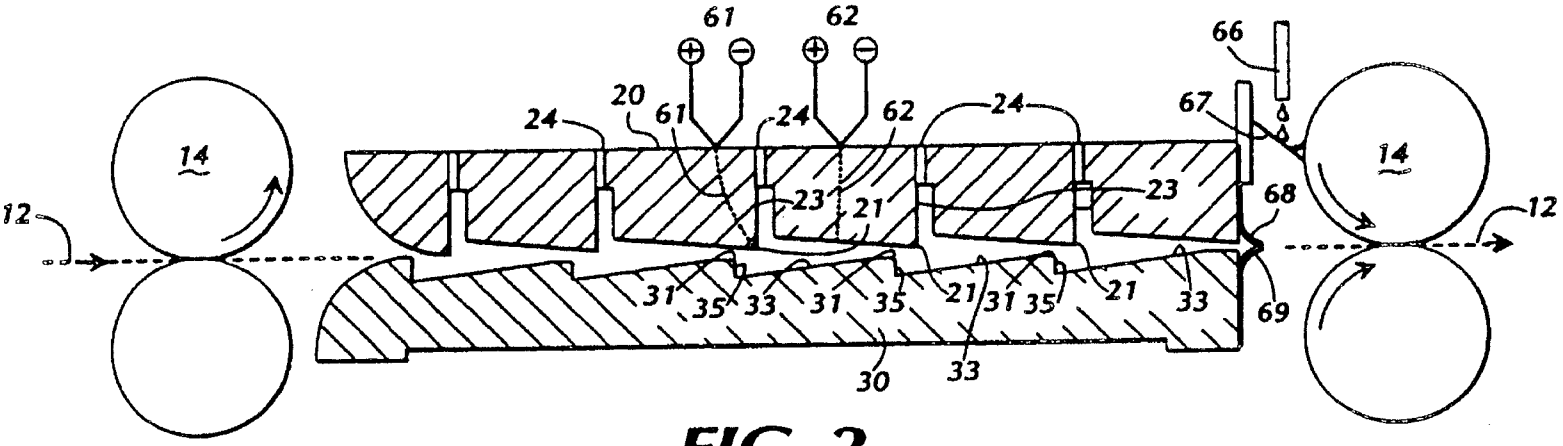
FIG. 2 is an end sectioned view of a preferred embodiment of the invention cell.
Figure 6:
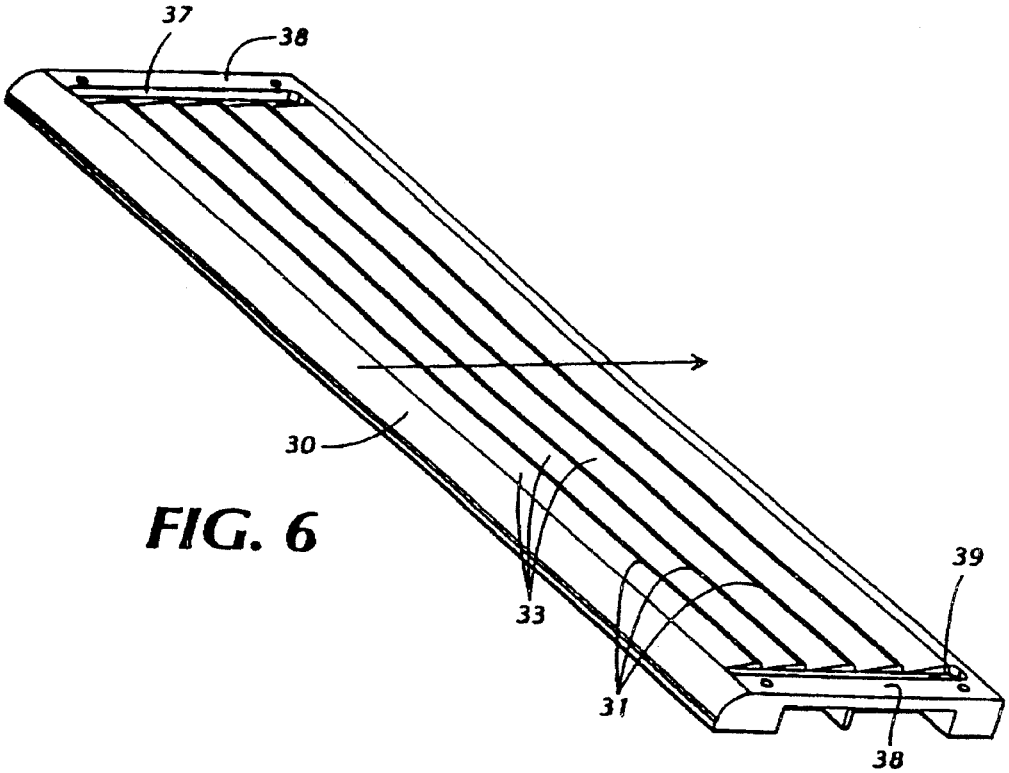
FIG. 6 is a top perspective view of an invention cell bottom plate.
Figure 7:
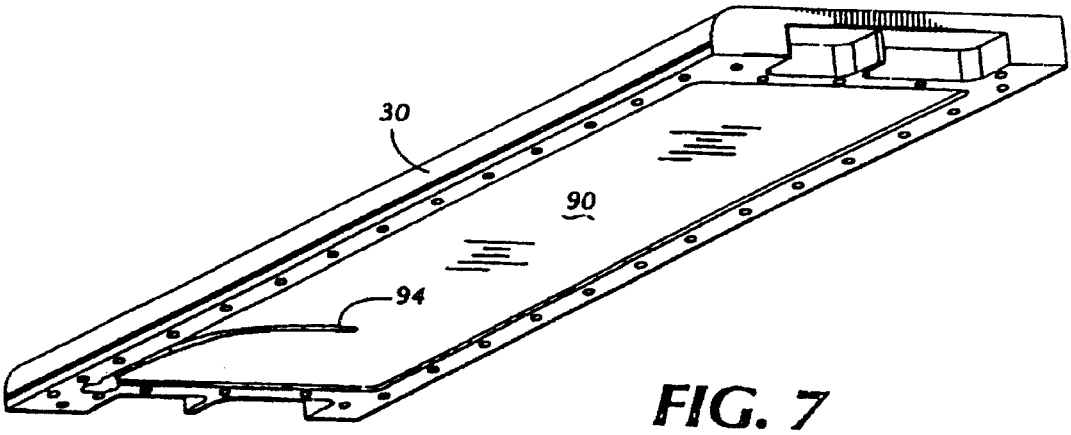
FIG. 7 is a bottom perspective view of an invention cell bottom plate.

With respect to the sectional elevation of FIG. 2 and the pictorial of FIG. 6, the internal volume between upper and lower plates 20 and 30 is floored by a saw-tooth surface characterized by a plurality of tooth edges 31 along the planar intersection of respective ramp faces 33 and rise faces 35. These tooth surfaces are oriented with the ramp surface 33 rising to the tooth edge 31 in the downstream PSM 12 flow direction. Spacing between adjacent tooth edges may be from about 0.25 to about 2.0 inches and preferably from about 0.50 to about 1.0 inches. Tooth edge rise may be from 0.05 inches to about 0.25 inches and preferably from about 0.070 to about 0.10 inches.

Figure 3:
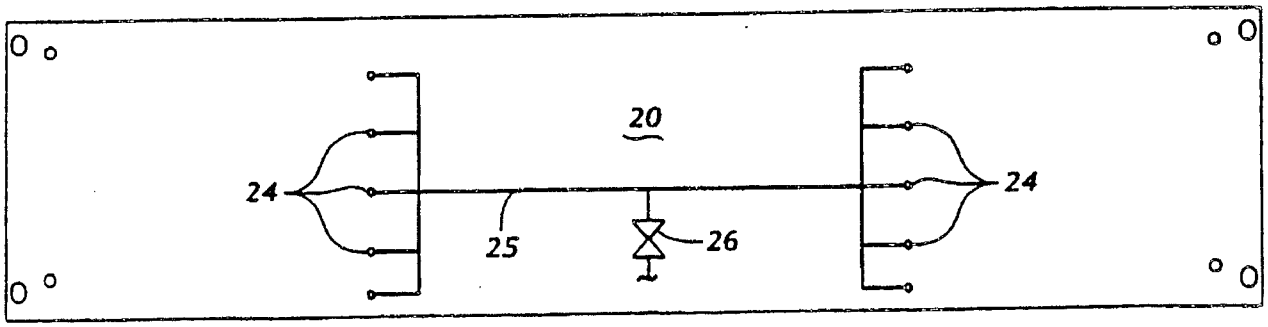
FIG. 3 is a top plan view of an invention cell top plate.
Figure 4:
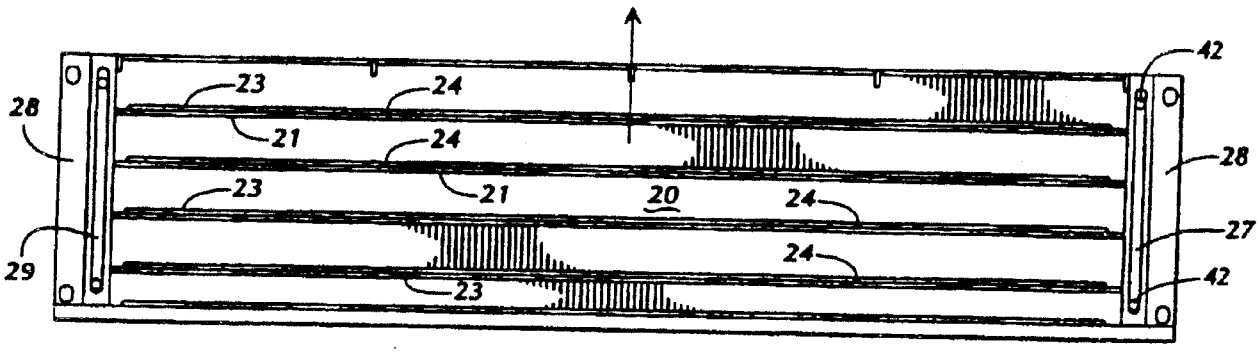
FIG. 4 is a bottom plan view of an invention cell top plate.
Figure 5:
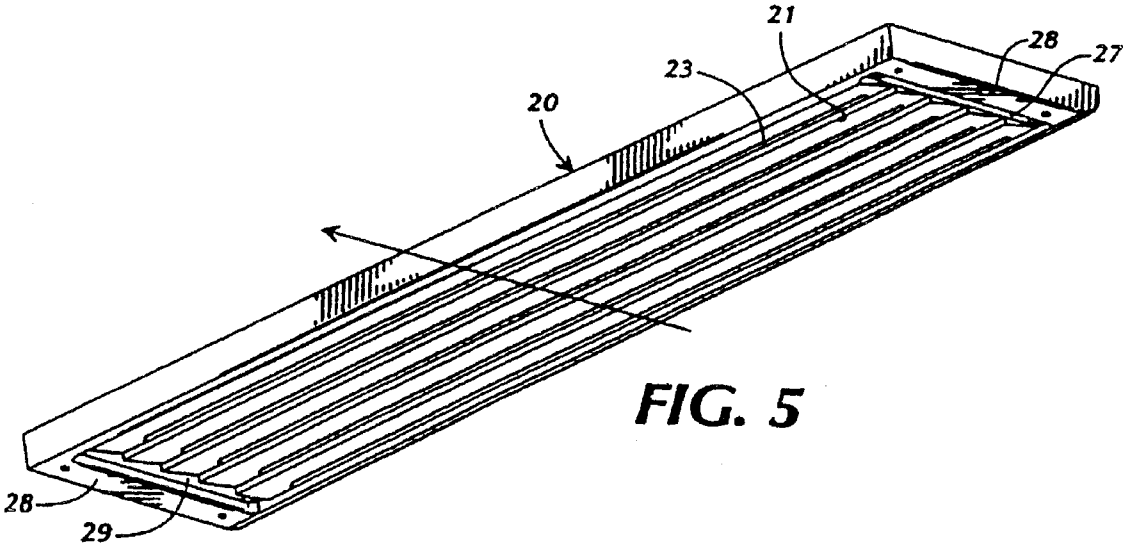
FIG. 5 is a bottom perspective view of an invention cell top plate.

Upper plate tooth edges 21 characterize the internal cell volume roof with a periodic spacing and rise similar to that below. Additionally, each upper tooth edge 21 is backfaced with a gas riser channel 23. The riser channels are vented to atmosphere at vents 24. In the FIG. 3 configuration of the invention, the vents 24 are connected with a conduit manifold 25 and controlled, whether open or closed, by a valve 26.

Spacing between a first plane common to the upper tooth edges 21 and a second plane common to the lower tooth edges 31 is within about 0.005 inches to 0.10 inches with the range of about 0.01 to 0.05 preferred. Although the tooth period of upper and lower plates 20 and 30, respectively, is substantially the same, the relative tooth alignment along the PSM traveling direction may be offset 0 to 50% and preferably about 0 to 25%.

Bottom plates 30 are also provided with process solution distribution channels 37 and 39. With respect to the circulation diagram of FIGS. 8 and 9, circulation pump 40 supplies the plate inlet channel 37 via supply conduits 42 and withdraws solution from channel 39 via the return conduits 44. Flow between distribution channels 37 and 39 is predominately parallel with the tooth edge line 31.

Similarly, upper plates 20 include process solution distribution channels 27 and 29 respectively connected with supply conduits 42 and return conduits 44 via parallel connected supply conduits 22 and 19. As with the lower plate, process solution flow is predominately parallel with the tooth edge line 21. However, the true nature of the solution flow is considerably more complex due to the moving, wetted surface of the PSM which carries some solution out of the cell and stimulates local turbulence.

Figure 17:
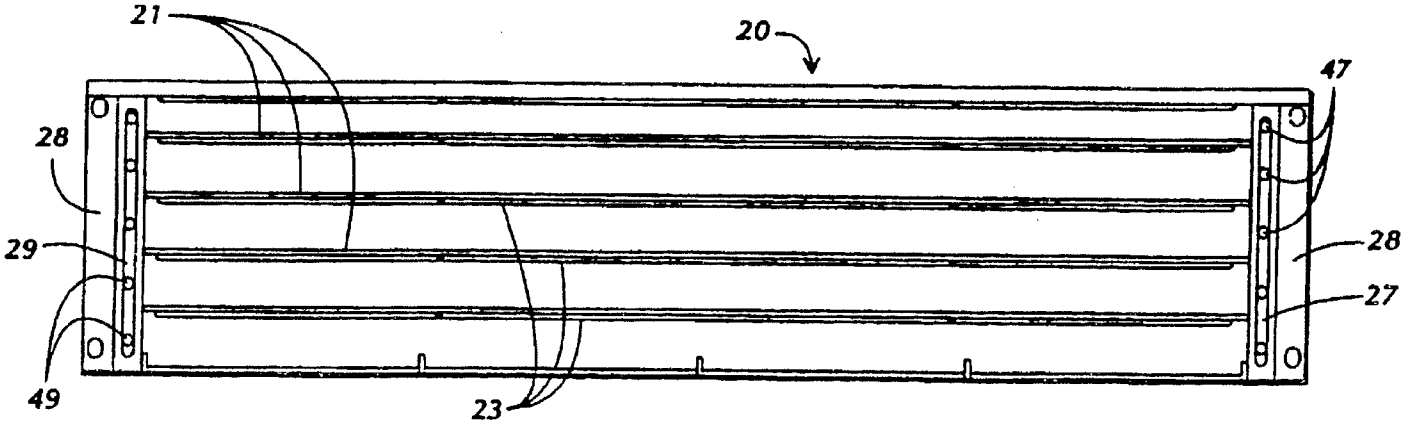
FIG. 17 is a bottom plan view of an alternative cell top plate.

FIG. 17 illustrates an alternative embodiment of an upper plate 20 having a multiplicity of solution circulation conduits 47 and 49 serving the distribution channels 27 and 29, respectively, in alignment with each tooth ridge 21 defined transverse flow channel. Obviously, the same multiple circulation conduit embodiment may also be applied to a bottom plate 30 design.

Figure 8:
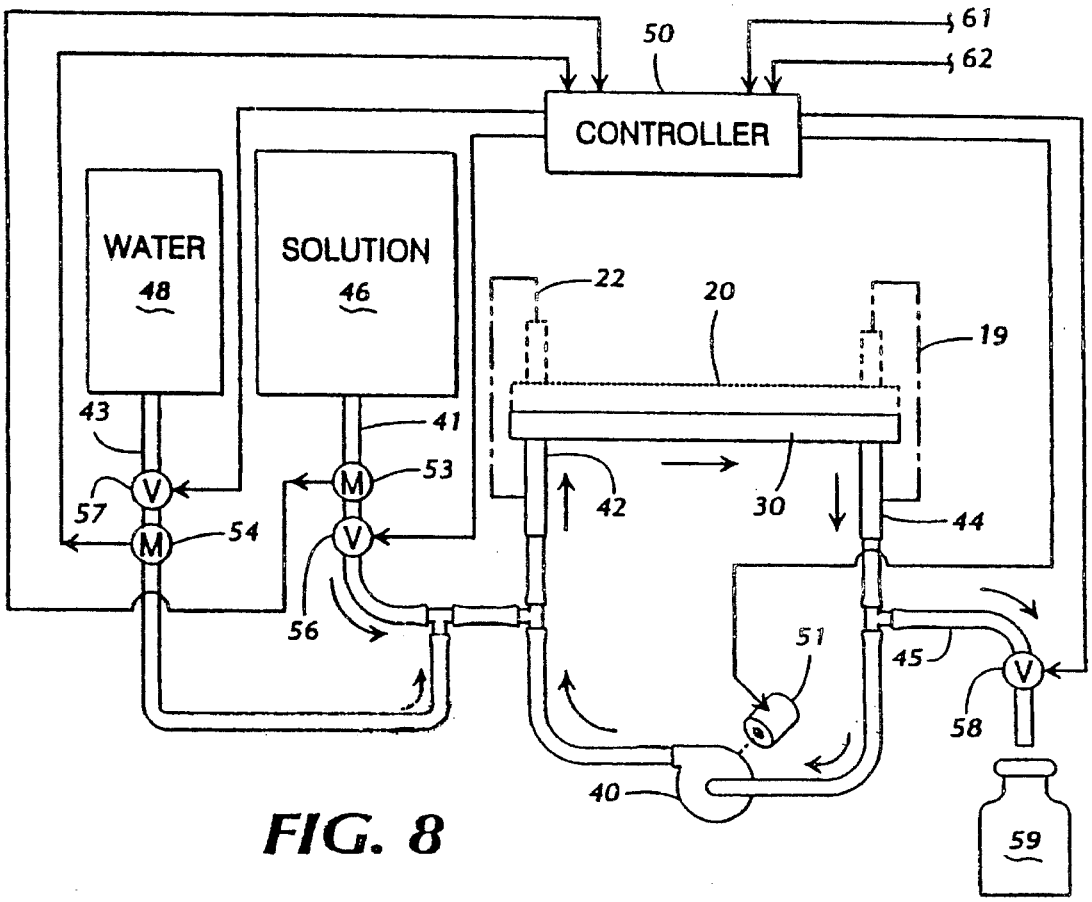
FIG. 8 is a fluid circuit schematic suitable for utilization by the invention.
Figure 9:
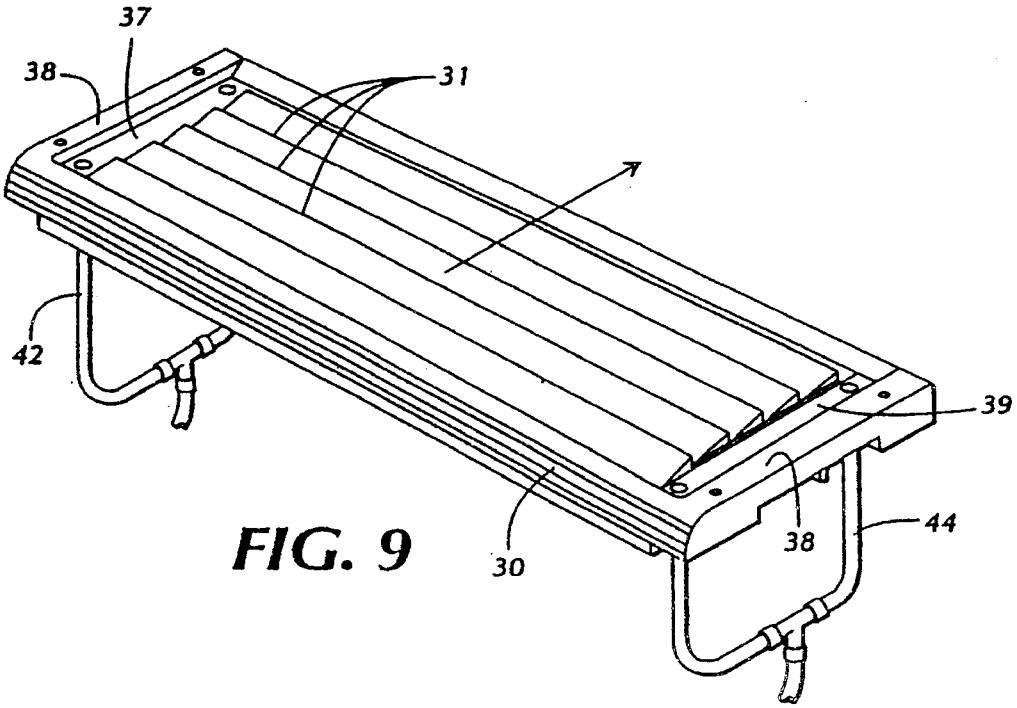
FIG. 9 is a top perspective view of the invention cell bottom plate.

The FIG. 8 process solution circulation system respective to each cell 10 in the process line also includes solution and wash water reservoirs 46 and 48, respectively, connected by conduits 41 and 43. A discharge conduit 45 connects the circulation system to a sewer or waste recovery vessel 59. Controller 50 receives operating flow data from meters 53 and 54. Normally closed valves 56, 57 and 58 are opened in response to controller 50 signal commands and pump motor 51 is regulated to maintain a predetermined cell solution flow rate or circulation velocity. As a percentage of the cell cavity volume between the floor and roof and between the solution distribution channels, that circulation may be in the range of 25% to 800% per minute. Preferably, the volumetric flow rate should be in the range of 50% to 500% per minute.

Vertical spacing between the upper and lower tooth edge planes is controlled by the plate 20 and 30 end faces 28 and 38, respectively. In assembly, these two end faces are aligned and secured in juxtaposition. Gaskets, not shown may also be used to skim the desired separation distance and to seal the cell ends fluid tight.

Blade squeegees 68 and 69, as seen in FIG. 2, along the cell exit opening also contribute to internal fluid confinement and to wiping the PSM surface. A trailing doctor blade 67 conditions the Upper squeegee roll 14 while flush water supply 66 supports the doctor blade cleaning and conditioning function.

Although it is not possible to entirely seal the internal cavity volume from process solution leakage, it is possible to minimize that leakage by solution fluid surface tension and cavity volume pressure control. Since the cell sides are sealed, solution is mostly lost only across the PSM entrance and exit openings. By controlling the clearance of the tooth edges above and below the PSM, liquid surface tension and meniscus forces will confine a sufficient pressure head to flood coat the PSM upper surface: if there are no air bubbles against the cell roof. It is concern for roof bubbles and the need to vent them from the cell cavity that is addressed by the gas riser channels 23 and vents 24. With such a minimum volume process solution system as disclosed hereby, the presence of a roof bubble can greatly distort cell solution distribution, concentration and reactivity.

As a general rule, a cell cavity volume will be flooded to about the root of the tooth 21 which is at the intersection of the plane extended from the tooth backface. This will exert an escape head at the entrance and exit of about 0.05 inch to about 0.125 inch, the tooth riser distance.

Process solution level and flow rate may be controlled by a pair of dual contact resistance probes 61 and 62 bedded into the upper plate 20. Each probe represents a pair of physically spaced insulated electrical contacts that are exposed to the solution liquid at respective distances from the PSM traveling plane. Probe 61 sensing point is high in the riser channel 23 whereas probe 62 is midway along the tooth backface. When no solution bridges a contact set, measured resistance across the contacts is considerably greater than the resistance measured when immersed in the process solution. Analysis of the relative resistance states provides a data base for operating the flow control motor 51 to achieve a relatively steady-state level within the cell.

When a cell is emptied for maintenance or cleaning, refilling necessarily would trap new air in the transverse flow channel between the tooth ridges 21 except for the gas riser channels 23. Hydrostatic forces naturally press the air into these channels 23 and the vent apertures 24. At a distance removed from the PSM traveling plane by the rise of a cell tooth, the air/solution interface area is sufficiently small to be reactively insignificant and of no disruption to the transverse solution flow.

Normally, atmospherically open vents 24 are preferred as providing immediate visual verification of roof purging and solution flow rate adjustment. Certain processes and solutions, however, may be better controlled as shown by FIG. 1 with a conduit 25 confined vent system that is controlled by a valve 26. The valve 26 may also be automatically or remotely operated. Once the cell is full as sensed by probes 61 and 62, the valve 24 can be closed and the solution will be essentially protected from any further exposure to additional air.

Figure 19:
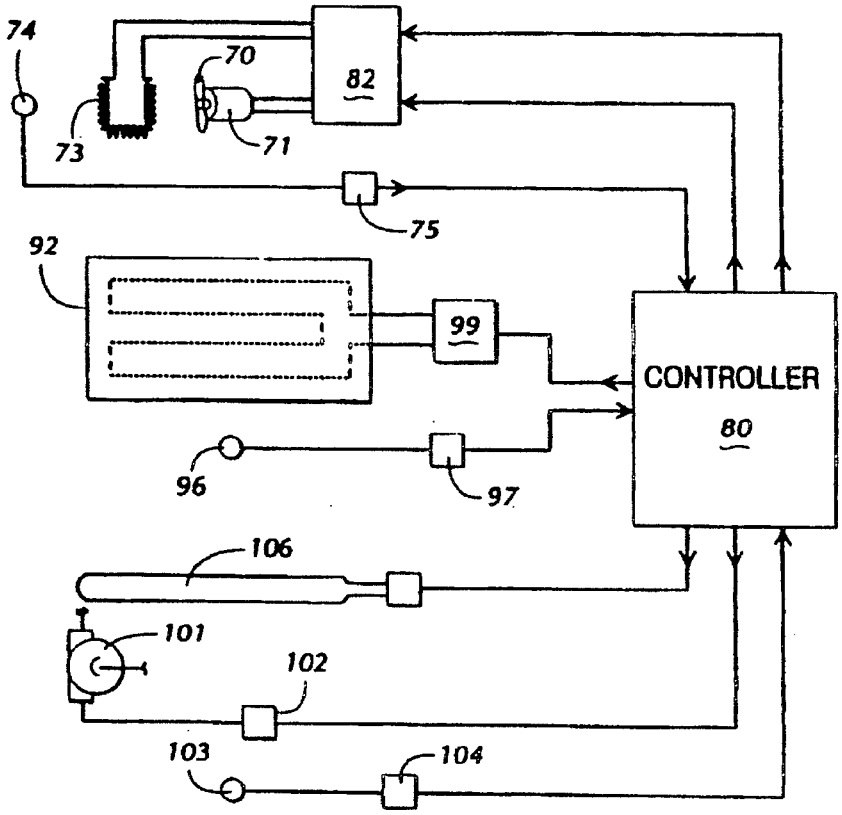
FIG. 19 is a system heat control schematic.

The dashed line 18 corner boundary of FIG. 1 represents an outer housing enclosing the cell processing line having internal air temperature and circulation control. To maintain close temperature control over variables influencing the PSM process, an integrated heat control system as schematically represented by FIG. 19 may be used to keep the air surrounding the processing cell units 10 within a desirable range. Within the enclosure 18 is a fan 70 driven by motor 71 to circulate internal enclosure 18 air across heating element 73. A temperature sensing probe 74 is positioned within the enclosure 18 and connected to an A/D converter to provide digital signal data to the system data processing controller 80 corresponding to the temperature of the air surrounding the cells 10. Responsive to set-point comparisons, the data processing controller 80 emits motor and heater operating commands to a power controller 82.

Figure 10:
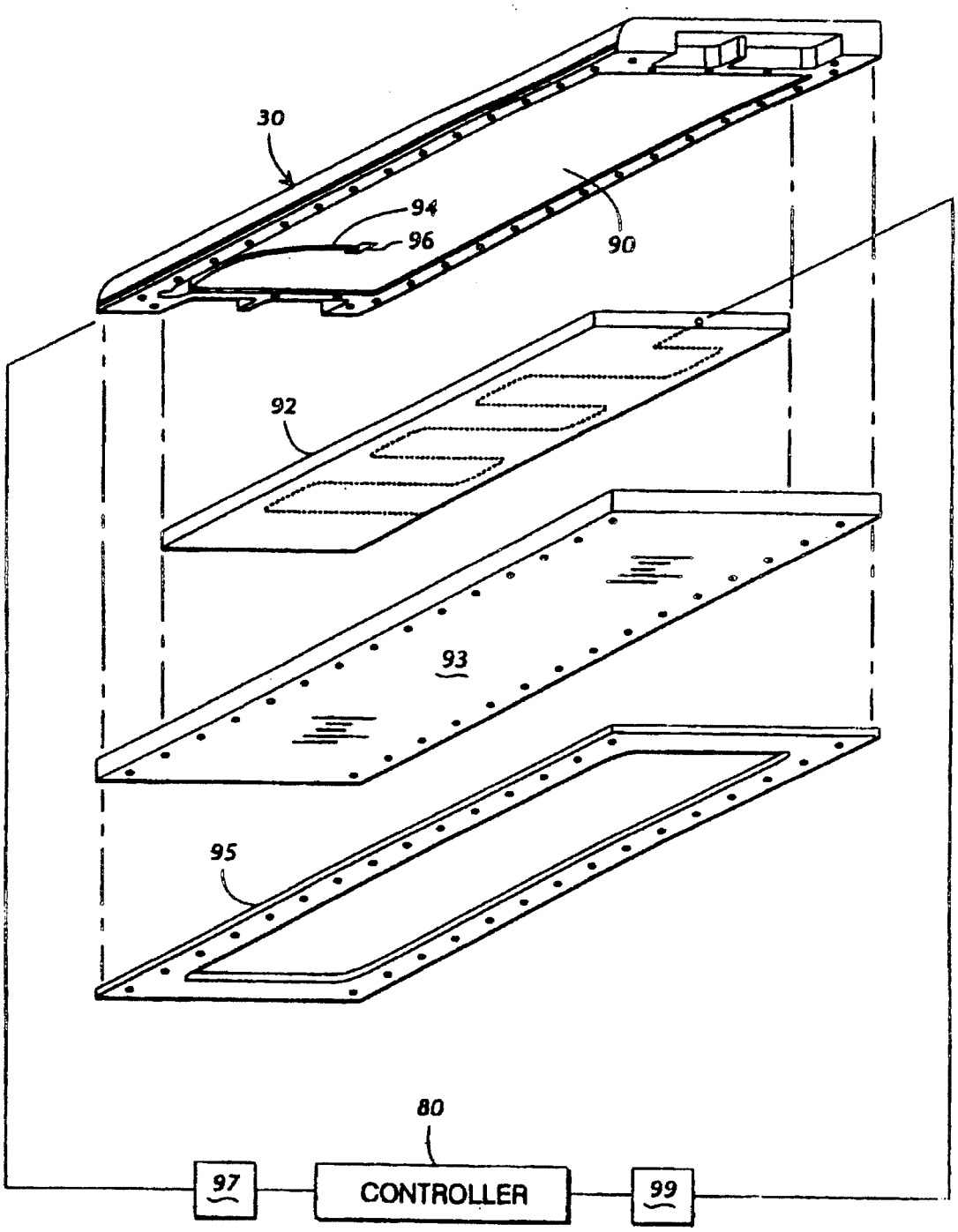
FIG. 10 is an expanded assembly perspective of the present invention bottom plate.

As an additional subsystem to the overall temperature control, each lower plate 30 is temperature regulated by means illustrated with FIGS. 10 and 19. The underside of the lower plate 30 is recessed 90 to receive an electric heating pad 92. More deeply recessed into the lower plate 30 structure is a bedding channel 94 for a temperature sensing probe 96 and signal carrier wire. An insulating cover plate 93 is secured in place by a flange plate 95. Fasteners not shown, located through and around the flange plate perimeter are threaded into the bottom cell plate 30 to unitize the assembly.

A/D converter 97 transmits corresponding temperature data in a form compatible with the data process controller 80 for set-point comparison. Responsive to signals from the power controller 99, resistance elements within the pad 92 are energized to conductively heat the structure of cell bottom plate 30.

If required or desired, the same cell plate temperature control system described above with respect to bottom plate 30 may also be implemented with respect to top plate 20 with due consideration given to the structural complication presented by the riser channels 23 and air vents 24.

Figure 18:
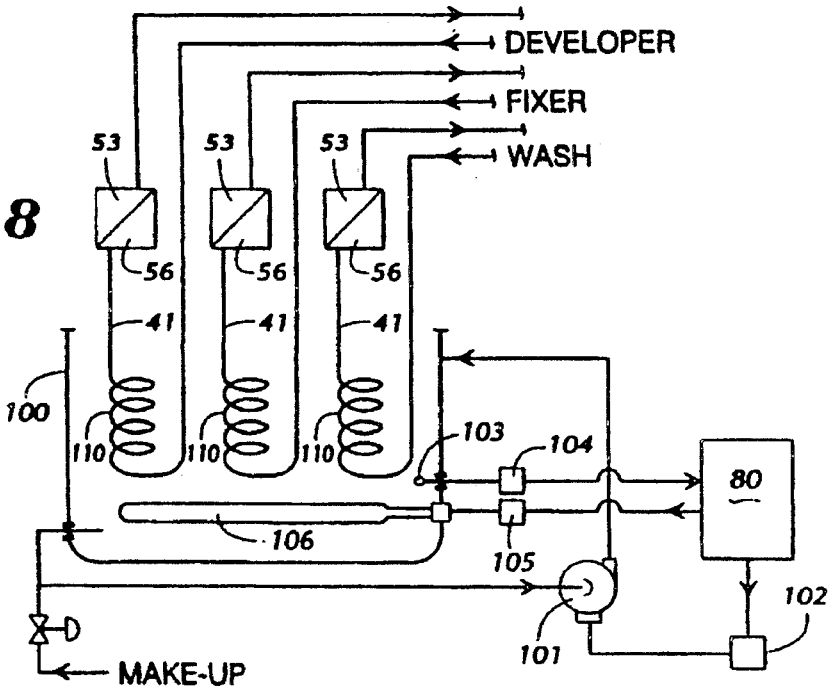
FIG. 18 is a solution heating system schematic.

Process solution make-up flow is temperature regulated by means of a liquid bath system as shown by FIG. 18. A containment vessel 100 for a liquid medium suitable for heat storage such as water or ethylene glycol is provided with an internal medium circulation system which includes a pump 101. Motor controller 102 is actuated by signals from the data processing controller 80. Analog signals from a temperature sensing probe 103 are converted by an A/D converter 104 to corresponding digital data and transmitted to the data processing controller 80 for set-point comparison. Responsively, controller 80 transmits a control signal to the heating element power controller 105.

Immersed within the liquid volume contained by vessel 100 are heat exchange coils 110 respective to each solution make-up stream respective to developer, fixer and wash, for example, that is to be maintained at the set-point temperature of this bath. There may be several solution make-up temperature control baths respective to different solution make-up streams and set-point temperatures.

These immersed heat exchange coils 110 are in conduit connection with respective solution make-up systems 41 that are regulated by the controller 50 to FIG. 8 and meters 53 and valves 56. Those of skill in the art will recognize that controller 50 of FIG. 8 may be the same as controller 80 of FIGS. 18 and 19, it or both being a pre-programmed, digital microprocessor. Nor is this to preclude the use of dedicated analog controllers for this purpose.

One of the objects and advantages of the present invention in placing all of the process variables such as solution flow rate, level control and temperature under a single control logic is the capacity to coordinate solution flow to actual usage and the particular PSM in process movement. At the extremely small cavity volumes corresponding to the PSM travel opening and clearance taught hereby, the flow demand differential between an interval with no PSM in transit and an interval with maximum PSM caliper in transit may be considerable. Additionally, normal maintenance procedures and cycles may be preprogrammed. For example, the controller or controllers may be programmed to terminate developer and fixer circulation at a certain time of day and to automatically flush the respective cell with water for a predetermined period of time. Moreover, a developer or fixer solution circulation may be abruptly replaced by water circulation to that respective cell thereby displacing the developer in the cavity and service conduits as a plug flow without opening the cavity to the atmosphere. Thereafter, water could be circulated through the developer cell during a non-service or non-attendance period. By repeating the plug flow displacement of water by the developer solution when required, the cell would never be allowed to dry out, or otherwise permit the entry of atmospheric air.

Figure 11:
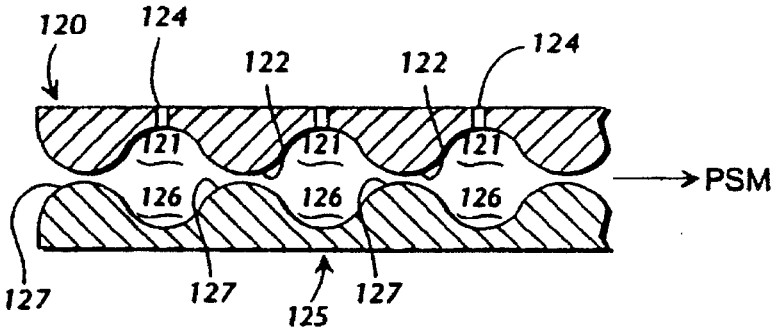
FIG. 11 is a partially sectioned view of a first alternative embodiment of the invention.

FIGS. 11 through 16 represent a few of the numerous geometric permutations of the invention with respect to ridge and cell cavity shape. FIG. 11 illustrates an upper cell plate 120 with rounded ridge lines 122 defining a sinusoidal cavity with transverse flow channels 121 therebetween. Air vents 124 penetrate the upper reaches of the flow channels. Rounded ridge lines 127. With respect to the PSM traveling direction, the upper and lower ridge lines 122 and 127 are vertically aligned with a 0% offset.

Figure 12:
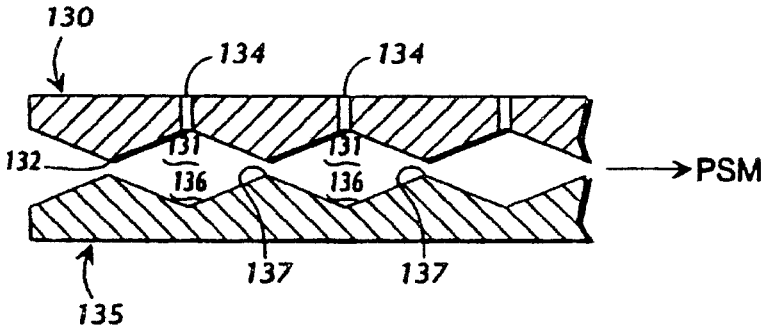
FIG. 12 is a partially sectioned view of a second alternative embodiment of the invention.

The FIG. 12 embodiment of the invention illustrates top and bottom cell plates 130 and 135, respectively, having a diamond shaped cavity volume formed by flow channels 131 and 136 between vertically aligned, top and bottom, symmetrical tooth, ridge lines 132 and 137. The upper flow channel 131 is penetrated by air vents 134.

Figure 13:
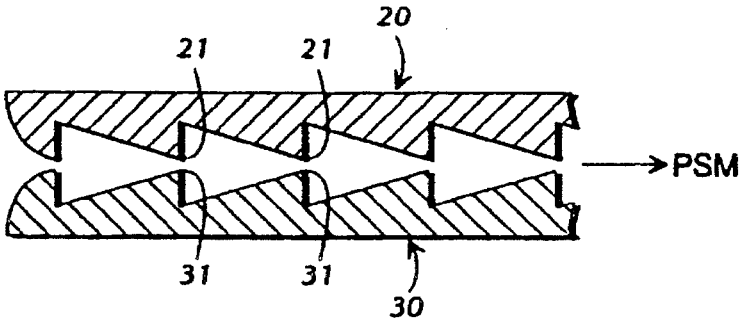
FIG. 13 is a partially sectioned view of a third alternative embodiment of the invention.

FIG. 13 represents the symmetrical tooth geometry of the preferred embodiment in vertical alignment with a 0% PSM travel direction offset.

Figure 14:
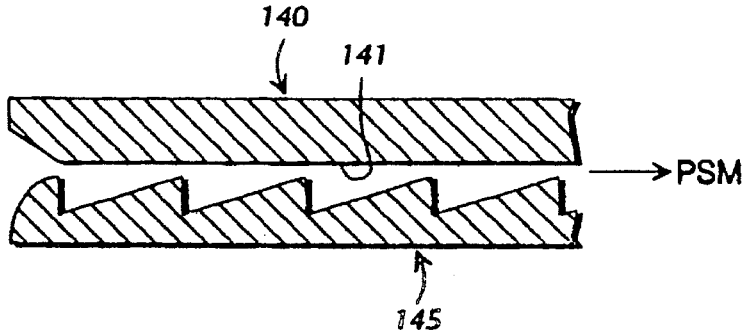
FIG. 14 is a partially sectioned view of a fourth alternative embodiment of the invention.

FIG. 14 illustrates a simplified form of the invention having only a tooth ridged bottom plate 145 matched to a flat roof 141 top plate 140.

Figure 15:
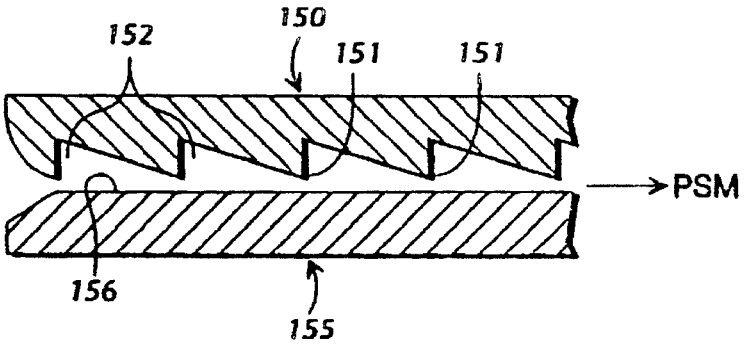
FIG. 15 is a partially sectioned view of a fifth alternative embodiment of the invention.

FIG. 15 represent the inverse of FIG. 14 with asymmetrical tooth ridges 151 defining flow channels 152 transversely of the PSM traveling direction aligned against a flat floor 156 of the bottom plate 155.

Figure 16:
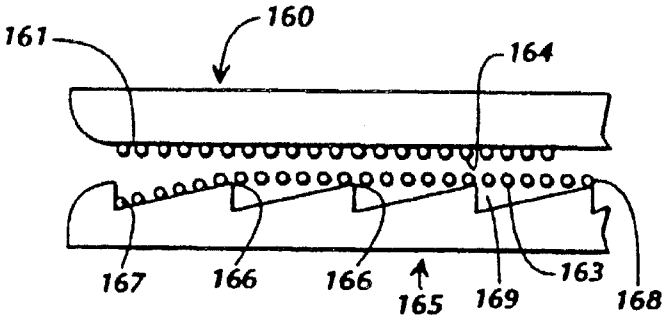
FIG. 16 is a partially sectioned view of a sixth alternative embodiment of the invention.

The invention embodiment of FIG. 16 is particularly distinctive with a mesh 163 drawn across tooth ridges 166 in bottom plate 165 beneath a similar mesh 164 secured to the bottom of the flat roof 161 of a top plate 160. This bottom mesh 163 is secured at the first tooth base and may or may not be secured at the mesh trailing and 168. Suitable materials for these mesh elements 163 and 164 include nylon, rayon, polyester, polypropylene and polyethylene. A mesh grid of 30 to 300 strands per inch is useful and a mesh of 50 to 200 strands per inch preferred. Such strands may range from 0.030 mm to 0.250 mm in diameter although a strand diameter of 0.050 mm to 0.150 is preferred. Solution flow through transverse channels 169 between the tooth ridges 166 and under the mesh 163 supports a complex, localized circulation and in some cases, a microturbulence within the mesh perforations to replenish the reactivity solution strength in direct contact with the PSM emulsion surface. The upper mesh 164 provides improved surface transport characteristics for the PSM which may otherwise adhere to the top surface.

If laid loosely across the tooth ridges 166, the mesh will find its own best proximity to the PSM surface. If drawn tightly and secured at downstream point 168 the mesh surface elements may be given precisely controlled proximity to a PSM of known thickness.

Obviously, the FIG. 16 embodiment is preferentially used with 1 side PSM. A 2 side PSM processing cell may include an upper and lower asymmetric tooth ridge configuration as taught by FIG. 2 with a mesh 163 drawn across both upper and lower tooth ridges. It should also be understood that the bottom mesh 163 may be secured at both the front and trailing ends but only loosely laid in between to allow some controlled, mid-span movement of the mesh.

Having fully disclosed the preferred embodiments of my invention,

I claim:

1. Apparatus for use in the processing of a sheet material coated on at least one side thereof with a photosensitive emulsion, the apparatus comprising:

top and bottom plates relatively aligned to provide a sheet processing chamber between a roof structure respective to said top plate and a floor structure respective to said bottom plate, a sheet material traveling plane passing through said processing chamber along a traveling direction, said processing chamber including a plurality of process fluid flow channels disposed across said processing chamber in an alternating manner between a plurality of ridge lines substantially parallel with said traveling plane and substantially transverse of said traveling direction, each of said top and bottom plates defining a process fluid supplier and a process fluid receiver, each of said process fluid suppliers being disposed along side said processing chamber and along one edge of said sheet material traveling plane, each of said process fluid receivers being disposed along side said processing chamber and along an opposite edge of said sheet material traveling plane; and, a process fluid circulation means for withdrawing process fluid from each of said process fluid receivers and delivering said fluid to each of said process fluid suppliers.

2. Apparatus as described by claim 1 wherein said roof and floor structures are separated along said ridge lines by a distance of about 0.005 inch to about 0.10 inch.

3. Apparatus as described by claim 1 wherein said circulation means delivers a process fluid quantity to said processing chamber at a delivery rate corresponding to about 25% to about 800% of the processing chamber volume per minute.

4. Apparatus as described by claim 1 wherein each of said plurality of fluid flow channels defines each of said plurality of ridge lines and are disposed in said roof and floor structure.

5. Apparatus as described by claim 4 wherein respective planes parallel to said traveling plane and including said roof and floor ridge lines are separated by a distance of about 0.005 inch to about 0.10 inch.

6. Apparatus as described by claim 4 wherein respective planes parallel to said traveling plane and including said roof and floor ridge lines are separated by a distance of about 0.01 inch to about 0.05 inch.

7. Apparatus as described by claim 4 wherein each of said plurality of fluid flow channels in said top plate defines at least one vent such that said plurality of fluid flow channels are vented to the atmosphere.

8. Apparatus as described by claim 7 wherein said at least one vent respective to each of said plurality of fluid flow channels is selectively opened and closed to the atmosphere.

9. Apparatus as described by claim 1 wherein sheet-like mesh means is secured within said processing chamber across said flow channels and ridge lines for direct contact with said sheet material.

10. Apparatus as described by claim 1 wherein said fluid flow channels and ridge lines are sectionally configured in a saw-tooth profile.

11. Apparatus as described by claim 1 wherein said plurality of fluid flow channels and said plurality of ridge lines are sectionally configured in a sinusoidal profile.

12. Apparatus as described by claim 4 wherein ridge lines respective to said roof and floor structure are disposed in relatively offset alignment along said traveling direction up to about 50% of the distance between adjacent ridge lines.

13. Apparatus as described by claim 4 wherein said plurality of ridge lines respective to said roof and floor structure are disposed in relatively offset alignment along said traveling direction up to about 25% of the distance between adjacent ridge lines.

14. A method for processing sheet material coated on at least one side thereof with a photosensitive emulsion, said method comprising the steps of:

providing a processing chamber between a roof surface and a floor surface through which a sheet material passes in a traveling plane and along a traveling direction, each of said roof and floor surfaces defining a plurality of ridges depending therefrom, each of said plurality of ridges extending along said processing chamber transverse to said traveling direction;

flooding said processing chamber between said roof surface and said floor surface with a process fluid; and, circulating said process fluid through said processing chamber parallel with said traveling plane and transverse to said traveling direction, said fluid being channeled between each of said plurality of ridges.

15. A method as described by claim 14 further comprising the step of separating planes parallel to said traveling plane and passing through said ridges, respectively, by a distance of about 0.005 inch to about 0.10 inch.

16. A method as described by claim 14 wherein elongated air pads are maintained between said ridges and above said flooded chamber.

17. A method as described by claim 16, wherein said air pads are selectively vented to atmosphere.

18. A method as described by claim 15 wherein parallel roof and floor ridges are oppositely offset by up to 50% of a separation distance between adjacent ridges.

19. A method as described by claim 15 wherein parallel roof and floor ridges are oppositely offset by up to 25% of a separation distance between adjacent ridges.

20. The method as described by claim 14 wherein said process fluid is circulated through said processing chamber at a flow rate corresponding to a range of about 25% to about 800% of the processing chamber volume per minute.

21. The method as described by claim 14 wherein said process fluid is circulated through said processing chamber at a flow rate corresponding to a range of about 50% to 500% of the process chamber volume per minute.

22. A system for processing photosensitive sheet material comprising:

a plurality of process cells in serial alignment along a material traveling route;

an environmental enclosure means substantially surrounding said plurality of process cells, said environmental enclosure means including atmosphere heating and circulation means for circulating and regulating the temperature of atmosphere within said enclosure means;

at least one process cell having a sheet material processing cavity between internal floor and roof means;

means for circulating process fluid through said cavity and transversely across said material traveling route, said means for circulating including control means for regulating the rate of said fluid circulation and for regulating a rate of process fluid make up: and, process fluid heating means for regulating the temperature of process fluid make-up to said means for circulating said process fluid.

23. A system as described by claim 22 having process fluid flow channels across said cavity transversely of said material traveling route, said flow channels being defined between parallel ridges within said cavity.

24. A system as described by claim 22 wherein said means for circulating process fluid includes wash means for substituting a wash fluid for said process fluid in said fluid circulation.

25. A system as described by claim 22 further comprising process cell structure heating means having means for sensing said structure temperature and for regulating the energization of said heating means responsive to said means for sensing.

26. A system as described by claim 25 wherein said control means for regulating the rate of said fluid circulation comprises fluid level sensing means for detecting the surface level of fluid within said cavity.

27. Apparatus for processing photosensitive sheet material coated on at least one side thereof with a photosensitive emulsion, said apparatus comprising:

top and bottom plate means relatively aligned to provide sheet processing chamber means between roof structure respective to said top plate means and floor structure respective to said bottom plate means, a sheet material traveling plane passing through said processing chamber means along a traveling direction, said processing chamber means including parallel ridges disposed across one of said roof or floor structures, perforated mesh means disposed across said parallel ridges between said ridges and said traveling plane to define fluid flow channels in said chamber means transverse of said traveling direction; and, fluid circulation means for supplying fluid to and extracting fluid from said flow channels.

28. Apparatus as described by claim 27 wherein said ridges are disposed across said roof and floor structures and said mesh is disposed respectively across roof and floor ridges, said material traveling plane passing between respective roof and floor mesh.

29. Apparatus as described in claim 27 wherein said mesh is a perforated grid of about 30 to about 300 strands per inch.

30. Apparatus as described by claim 28 wherein said mesh is a perforated grid of about 30 to about 300 strands per inch.

31. Apparatus as described by claim 27 wherein said mesh is a perforated grid of about 50 to about 200 strands per inch.

32. Apparatus as described by claim 28 wherein said mesh is a perforated grid of about 50 to about 200 strands per inch.

* * * * *